United States Patent [19]

Johnson

[11] Patent Number: 4,638,620

[45] Date of Patent: Jan. 27, 1987

[54] CARTON FLAP OPENER

[75] Inventor: Lloyd D. Johnson, Portland, Conn.

[73] Assignee: Standard-Knapp, Inc., Portland, Conn.

[21] Appl. No.: 726,093

[22] Filed: Apr. 23, 1985

[51] Int. Cl.[4] ..... B65B 43/38

[52] U.S. Cl. ..... 53/382

[58] Field of Search ..... 53/381 R, 382; 493/177, 493/183, 310, 318, 424

[56] References Cited

U.S. PATENT DOCUMENTS

| | | | |
|---|---|---|---|
| 2,890,560 | 6/1959 | Nigrelli et al. | 493/177 X |
| 3,224,165 | 12/1965 | Nigrelli et al. | 53/382 |
| 3,247,646 | 4/1966 | McIntyre | 53/382 |
| 4,191,005 | 3/1980 | Vinoskey | 53/382 |
| 4,460,349 | 7/1984 | Charron | 493/177 X |
| 4,478,023 | 10/1984 | Becker | 53/382 |

*Primary Examiner*—John Sipos
*Assistant Examiner*—Steven P. Weihrouch
*Attorney, Agent, or Firm*—McCormick, Paulding & Huber

[57] ABSTRACT

Three wheels rotate together to achieve sequential movement of the leading top flap of a conventional packing case such that the case has its top flaps outfolded prior to the arrival of the case at a load station in a continuous motion packer.

6 Claims, 3 Drawing Figures

CARTON FLAP OPENER

This invention relates generally to apparatus for opening the leading top flap of an upwardly opening packing case of the type having side panels and front and rear end panels. The side panels each have top flaps and leading and trailing top flaps are provided on the front and rear end panels respectively.

Both side top flaps and the trailing top flap can generally be opened or "out-folded" by conventional means, as shown for example in U.S. Pat. Nos. 2,890,560, 2,918,773, and 3,224,165. The advent of case packers with continuously moving cartons or cases in state of the art continuous motion packers has created a situation where present day flap openers are not reliable when cycled fast enough to open the leading top flap while the case is moving. U.S. Pat. No. 3,852,942 shows a typical carton flap opener of the type adapted for use when the cases are periodically stopped during their progress toward a loading station where the upwardly opened packing cases are filled with slugs or groups of articles of predetermined configuration.

A typical continuous motion packer is shown in U.S. Pat. No. 4,457,121 issued July 3, 1984 to the assignee herein. The general purpose of the present invention is to provide an improved carton flap opener of the type adapted for use with the carton feed portion of such a continuous motion packer. In a pending application Ser. No. 579,215 entitled "Case Feed for Continous Motion Packer" filed Feb. 10, 1984 an improved carton feed is disclosed for such a continuous motion packer and the present invention is specifically designed for use with such a carton feed. The disclosure in this co-pending application Ser. No. 579,215 is incorporated by reference herein. However, the carton flap opener to be described can also be adapted for use with any case infeed conveyor of the type which is adapted to operate continuously, that is with some speed variation but without stopping the case. The carton flap opener to be described is readily correlated in speed to that of the conveyor to achieve a smooth and efficient opening of the leading top flap in a carton or case packing machine capable of continuously advancing the cases through a case loading station.

In accordance with the present invention upwardly open packing cases, with the top flaps in-folded, are moved through the apparatus to be described for folding these top flaps outwardly as the packing case is moved continuously toward the case loading station where the packing cases are adapted to be filled with slugs of articles. Since the packing cases are moved continuously, the leading top flap must be opened by a device operating at a speed higher than that of the packing cases themselves, and the present invention provides such an apparatus above the path of movement of the case and operable in timed relationship with the case conveyor.

SUMMARY OF THE INVENTION

This invention resides in a machine of the type wherein upwardly open packing cases are moved downstream in space relationship to one another toward a load station or the like. The cases have their top flaps hingedly connected to at least the front and rear panels thereof and generally to all four panels of the upwardly open packing case such that these top flaps must be opened prior to arrival of the packing case at the load station. In accordance with the present invention a leading front top flap opening mechanism is provided above the path of movement of the cases and includes rotating flap engageable wheels so clustered that their axes are spaced from one another less than one half their combined diameters. Thus, their respective peripheries have segments that overlap one another at least slightly. Adjacent clustered wheels are displaced axially relative to one another so that their overlapping segments do not interfere with one another as they rotate at substantially the same speeds. The upstream one of said adjacent clustered wheels defines a radially outwardly open notch with a first side trailing a second notch side as the wheel is viewed in the direction of rotation. The first notch side is more particularly defined by a radially outwardly, and tangentially forwardly projecting portion of one wheel's periphery such that this portion moves downwardly into the packing case and then upwardly at a peripheral speed greater than that of the packing case so to raise the leading top flap as said one wheel rotates through an angle at least approximately equal to that of the angular displacement of the top flap itself, as measured from its initial in-folded position. Another of these adjacent and clustered wheels also defines a radially outwardly open notch, also with a first trailing and a second leading notch side, and the first notch side thereof is engageable with the leading top flap as said projecting portion of the one wheel moves upwardly out of contact with said leading top flap whereby the top flap is further folded through an additional angle corresponding to the additional angular displacement of the top flap itself as measured beyond the angular displacement associated with the one wheel. The second wheel is perpherally of the same general diameter as the first but is spaced slightly above it and may include a radially outwardly projecting peripheral segment opposite that defining the notch such that the trailing top flap can be continuously held in its out-folded condition, at substantially right angles to the packing case, as the top flap is being out-folded forwardly. Further, a third wheel is provided on the same horizontal line or plane as the first wheel and also includes a notch with one side adapted to sequentially act on the forwardly folded top flap to hold this leading top flap downwardly until it can be engaged by a fixed plow and held in the out-folded position for loading at the discharge station of the continuously operating packer. The third wheel also has a peripheral segment overlapping a segment of the second wheel.

In its presently preferred form the case feed conveyor system with which the above described leading top flap opener is adapted for use is that described in the above mentioned co-pending patent application Ser. No. 579,215 filed Feb. 10, 1984 and entitled "Case Feed for Continuous Motion Packer". In its presently preferred form the case feed for such a continuous motion packer provides for sequentially accelerating and decelerating the packing cases to correlate the speed of each case with the horizontal component of velocity of an orbiting grid in which the articles to be packed are transported so that the articles can be dropped into the case at the discharge or load station of the Continuous Motion Packer. Thus, the speed of movement of the cases on the case feed conveyor system need not be constant but may vary from a maximum to a minimum and this situation may obtain at the carton top flap folding mechanism or station to which the present invention is directed. In such a situation, that is where the packing case speed varies between a maximum and a minimum value it is advantageous to locate the carton top flap folding mechanism at an appropriate position above the case feed conveyor system such that this top flap is moved from its in-folded condition to its out-fold condition during that phase of the cycle of movement for the case where its speed is at a minimum. It should be noted, however, that the present invention might also be adapted for use in a case conveyor system where the cases move at a constant speed. The significant advantage here lies in the capability of accommodating the cases without interrupting their movement.

The chief aim of the present invention is to provide an improved leading top flap outfolding mechanism designed to achieve initial in-folding of the leading top flap toward its open condition while the case is moving along a conveyor of the type adapted to continuously feed the case toward the loading station of a continuous motion packer.

DETAILED DESCRIPTION

Figure 1:
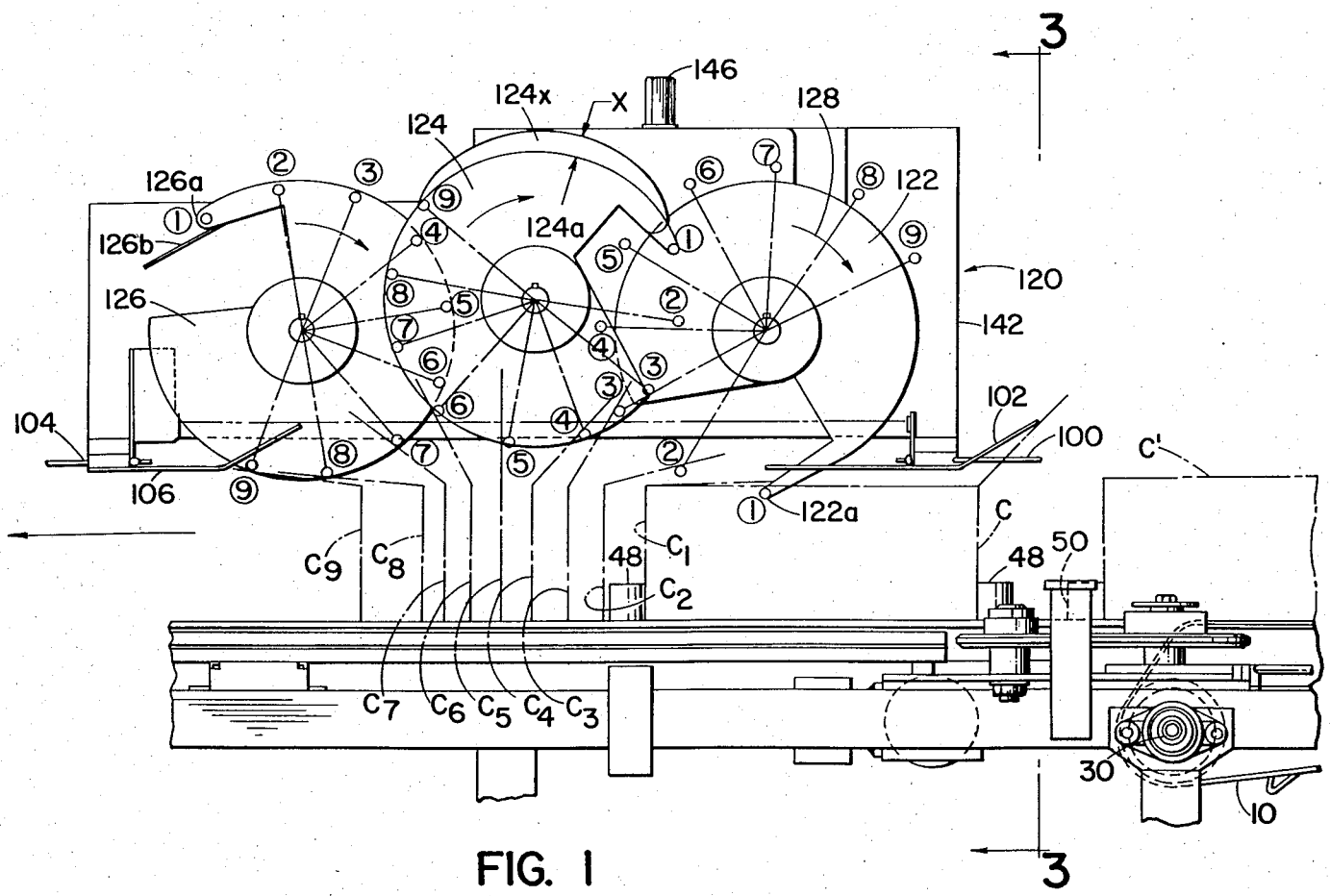
FIG. 1 is a side elevational view of a preferred embodiment, with portions broken away to reveal the clustered leading top flap opener wheels provided above the path of movement of the cases on a case conveyor system of the type described in the above mentioned co-pending patent application Ser. No. 579,215. This view corresponds to FIG. 2A of said co-pending patent application and similar components of the case conveyor system carry the same reference numerals as utilized in said co-pending patent application.
Figure 2:
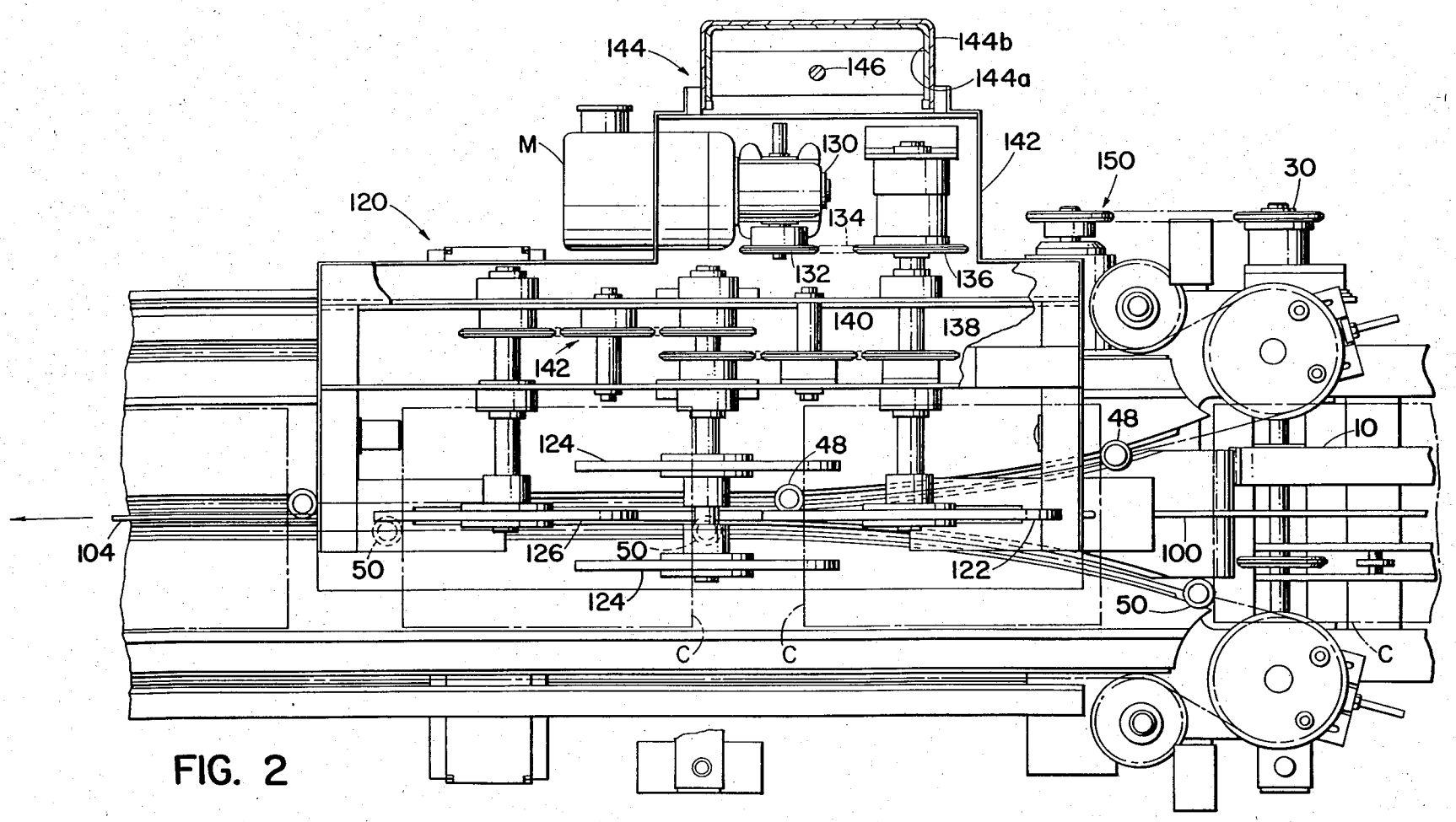
FIG. 2 is a top plan view of the apparatus depicted in FIG. 1 with portions broken away for clarity, and this view corresponds to FIG. 1A of said co-pending patent application, again with similar parts being designated with common reference numerals to those in the prior co-pending patent application.

Turning now to the drawings in greater detail, and referring particularly to FIG. 1, in-feed conveyor means is provided, as indicated generally at 10, to feed upwardly open packing cases C into a case conveyor system of the type described in said co-pending patent application Ser. No. 579,215. Such a case conveyor system has independently driven conveyor components for handling the successively spaced cases such as shown to best advantage in FIG. 2. As shown in FIG. 2, and looking in the downstream direction of the case conveyor system, paired lugs 48, 48 and 50, 50 are provided on side-by-side case conveyors to handle each of the successively moved cases C and C1 in order to achieve the independent and variable speed motion of each successive case as it is advanced toward the load station of a state of the art "Continuous Motion Packer" such as that referred to previously with reference to U.S. Pat. No. 4,457,121.

The case conveyors so defined by these continuously moving lugs, 48 and 50, are driven at speeds which are correlated to that of the in-feed conveyor 10, both such systems being driven from a common source of power through cross conveyor shaft 30 associated with the in-feed conveyor 10. The downstream or driven end of the case conveyor system is not shown, but is described in the above identified co-pending application Ser. No. 579,215.

Although not shown in said prior co-pending application means is preferably provided for opening the trailing top flap and the top flaps associated with the side panels of the case. The mechanism for opening these top flaps may be similar to that disclosed in the two prior art patents referred to previously. As disclosed therein the trailing top flap is folded outwardly by a fixed plow (not shown) and held in its open condition by a longitudinally extending cable 100 of the type commonly provided for this purpose in prior art machines. Cable 100 terminates at the upstream end of the leading top flap folding mechanism 120 to be described, and a fixed plow 102 is provided to prevent the trailing top flap from reclosing as best shown in FIG. 1. A second cable 104 is attached to at the downstream end of the mechanism 120 and serves to hold both the leading and trailing top flaps in their open or out-folded conditions after they are acted upon by the mechanism 120 to be described. A second fixed plow 106 may be provided to cooperate with the cable 104 in this regard.

Figure 3:
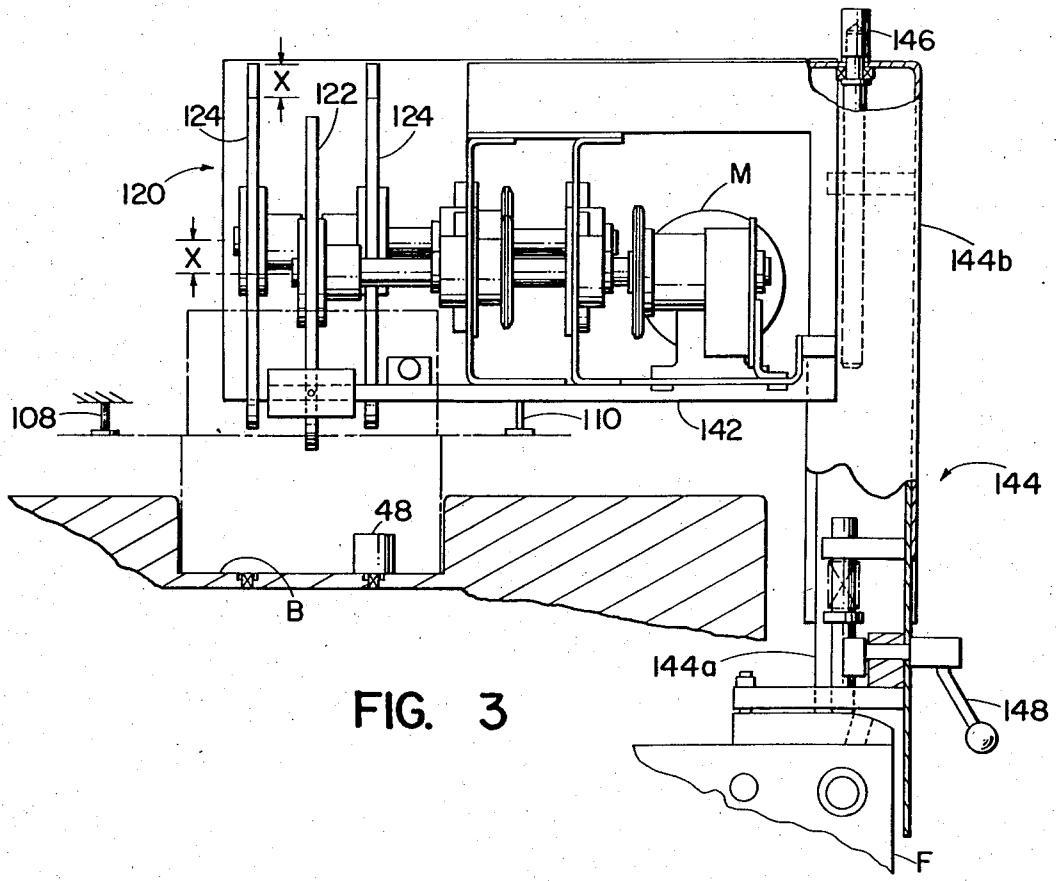
FIG. 3 is a vertical sectional view taken generally on the line 3—3 of FIG. 1 again with portions broken away and with similar case conveyor system components designated by similar reference numerals.

The top flaps associated with the side panels are also held open as the case passes through the mechanism 120, as best illustrated in FIG. 3, and fixed guides 108 and 110 are provided to hold the top flaps associated with the case side panels in their open condition as the case moves downstream towards the case loading station. Thus, the trailing top flap and the top flaps associated with the side panels are adapted to be out-folded by known means, and the latter flaps to be held in their out-folded positions by conventional devices. The present invention relates to holding the trailing top flap open and to the out-folding of the leading top flap associated with the front panel of the packing cases.

Turning now to a more complete description of the mechanism 120 for opening, or folding outwardly the leading top flap as the case moves below said mechanism 120, FIG. 1 shows three wheels 122, 124 and 126, all of which wheels are driven in a clockwise direction as viewed in FIG. 1 at substantially the same speed and operate in a cyclical fashion in timed relationship to the varying speed of the case conveyor system itself. This wheel speed is such that the lower peripheries of the three wheels are driven at a tangential speed which exceeds that of the case C that is being advanced by the case conveyor system described previously. The case conveyor system actually moves the cases at a speed which varies cyclically, but it is noted that even at the minimum speed of the cases moving on the case conveyor system the wheel peripheries exceed such minimum speed in order to function properly and to accomplish the results for which the mechanism 120 is designed.

Still with reference to FIG. 1 one of several cases C, $C_1$ is there shown in several successive positions represented by the leading front panel $C_1$ of the case C. These successive positions are nine in number and are designated in the drawings by the references numerals $C_1$ through $C_9$ inclusively. The respective positions of the active peripheral segments of the wheels 122, 124 and 126 are also illustrated in FIG. 1 at positions corresponding to these successive case positions so to the leading top flap position associated with these positions $C_1$–$C_9$ inclusively is also shown in FIG. 1. The upstream or first wheel 122 occupies the position shown when the case C is in position $C_1$. That is the front panel $C_1$ occupies the position shown in FIG. 1, and its top flap is still in-folded and has just been engaged by a projecting portion 122*a* of wheel 122 such that further clockwise rotation of wheel 122 in the direction of the arrow 128 will cause this top flap to move upwardly through approximately a 30 degree angle from position 1 of projecting nose portion 122*a* to a second the position indicated by the encircled number 2, 2 .

As the top flap is so raised the carton or case C will have progressed to the position shown at $C_2$ in FIG. 1, and further clockwise rotation of the wheel 122 through a further angle of approximately 30°, corresponding to that required to reach position 3 in FIG. 1, will achieve further lifting action of the front top flap of the carton or case C. The location for the front panel of the carton C indicated at $C_3$ in FIG. 1 shows the influence of the second wheel 124.

Lifting action of the front top flap will be achieved by nose portion 124*a* of the second or intermediate wheel 124 in the cluster of wheels and this interaction between nose portion 124*a* and the leading top flap occurs at or just prior to position 3 in FIG. 1 for wheel 124. That is projecting portion 122*a* of wheel 122 will pass out of contact with the top flap shortly after the top flap is engaged by the nose portion 124*a* of wheel 124. At position 4 wheels 122 and 124 will have moved through a further such angle, and the top flap actually loses ground relative to the front panel as indicated by comparing the broken lines $C_3$ and $C_4$ of FIG. 1. However, further angular movement of wheel 124 from position 4 to position 5 will result in the top flap being lifted to a near vertical position, indicated generally by the broken line $C_5$ of FIG. 1. Finally, and still with reference to the intermediate wheel 124, nose portion 124*a* then moves from position 5 to position 6 with the result that the top flap of the front panel of the case C is moved forwardly through the plane of the front panel itself as indicated generally by the broken line $C_6$ in FIG. 1.

The third wheel 126 also defines a notched portion, and a leading edge 126*a* of its notched portion has a spring finger 126*b* provided thereon and the free end of finger 126*b* projects slightly beyond the periphery of the wheel itself as shown in FIG. 1 at position 1 . As nose portion 124*a* of second wheel 124 moves through position 6 the spring finger 126*b* of the third wheel 126 moves from a position above that occupied by the nose portion 124*a* in position 6 and toward position 7 FIG. 1, to further fold the top flap forwardly relative to the front panel of the case, as indicated by the broken lines $C_7$ in that view. The spring finger 126*b* trails the leading edge 126*a* of the notched wheel 126, and the spring finger 126*b* serves to bias the top flap downwardly, assuring that it remains in its out-folded position such that it is oriented at approximately 90 degrees to the front panel, where it will be held by fixed plow 106 for further movement downstream. Broken lines $C_7$ and $C_8$ and $C_9$ illustrate this folding action of the wheel 126. As the case front panel reaches and passes the position indicated generally by the broken line $C_9$ the front top panel of the case will have been folded through approximately 180 degrees and will be held in the out-folded position shown at $C_9$ by the fixed plow 106, and subsequently by cable 104. Thus, carton C has all top flaps opened to receive articles dropped into the carton or case as described more fully in the above mentioned U.S. Pat. No. 4,457,121.

From the foregoing description of the operation for the cluster of three wheels illustrated in FIG. 1 the reader will now be able to better understand the reasons for the unique configuration of each of these three wheels. The first wheel 122 has a radially outwardly open notch defined by leading and trailing side edges, and it is apparent from FIG. 1 that the trailing side edge of the notch defines the projecting nose portion 122*a* referred to previously. This nose portion 122*a* projects forwardly, and radially outwardly beyond the periphery of the wheel 122 at least slightly so that the end portion thereof will dip below the plane defined by the top edges of the front and rear side panels of the carton C to assure that the leading top flap of the case is lifted upwardly as a result of the action described in the preceeding paragraphs.

Still with reference to FIG. 1 the intermediate or second wheel 124 has its axis located slightly above a line connecting or a plane through the axes of rotation for the first and third wheels 122 and 126, and it will also be apparent from FIG. 1 that peripheral portions of each of these three wheels overlap one another in order to achieve the action described above. Intermediate wheel 124 actually comprises two axially spaced discs 124, 124 as best shown in FIG. 3. This geometry facilitates this feature of overlapping segments to achieve the above described folding action of the front top flap of the carton. The intermediate wheel 124 also defines the radii of the outwardly open notch with leading and trailing sides, the trailing notch side defining the projecting nose portion 124*a* referred to previously. In addition, intermediate wheel 124 has a radius of its outwardly projecting portion oriented rearwardly in the direction of rotation of the nose portion 124*a*.

The intermediate wheel 124 also has a radially outwardly projecting segment 124*x* provided adjacent to and trailing its nose portion 124*a* so that the trailing top flap of the carton C is held down during movement of the carton. The radially outwardly projecting portion 124*x* of wheel 124 is defined by a peripheral segment which extends radially outwardly a distance corresponding closely to the vertical spacing X between the axis of rotation of wheel 124 and a line connecting or plane through the axes of rotation of wheels 122 and 126. The actual spacing X of axis of rotation of the intermediate wheel 124 above this line is best shown in FIG. 3.

The third wheel 126 also defines a radially outwardly open notch, the leading side edge of which notch, rather than the trailing side edge, defines its active portion 126*a*. That is this third wheel portion 126*a* engages the leading top flap further folding it forwardly from position 7 at least to position 9 as indicated in FIG. 1. This portion 126*a* of wheel 126 preferably has a resilient finger portion 126*b* provided thereon, which portion 126*b* projects radially outwardly, and also in the reverse direction of rotation relative to the rotating wheel 126, and serves to further fold the top flap into a substantially perpendicular out-folded relationship to the front panel as discussed above.

Turning next to a more complete description of the support structure for the three wheel cluster 122, 124, and 126, FIG. 3 shows a motor M, a right angle drive unit 130 for rotating sprocket 132 and drive chain 134, which chain in turn drives sprocket 136 associated with the cross shaft 138 first wheel 122. All the wheels in the cluster are driven at substantially the same speed through gear trains, 140 and 142, associated with the wheels, 124 and 126 respectively. FIG. 3 shows the motor and the support structure 142 associated wheel driving mechanism. The movement of the three wheels must be cycled to coordinate the above described motion of said wheels to that of the cases, and a single revolution clutch is electrically controlled to achieve this timing. The support structure 142 is cantilever mounted on a vertical post 144, which post is in turn supported from the fixed frame F of the carton conveyor frame. Post 144 includes a lower post portion 144*a* fixed to the frame F and an upper post portion 144*b* adjustably movable relative to the lower portion in order to vary the height of the three wheels 122, 124, and 126 relative to the bed B of the case conveyor system itself. A hand crank (not shown) may be provided on jack screw 146 in order to raise and lower the support structure 142 for the motor and its associated drive means relative to the bed B of the case conveyor and a lock lever 148 is preferably provided also to secure the telescoping post in its preadjusted position so as to accommodate cartons of predetermined height. It will be apparent that the motor M and the above described wheel cluster 122, 124, and 126 must be accurately indexed relative to the position of the case C on the case conveyor system itself, and that motor M is preferably synchronized with the drive 150 for the case conveyor. Both the case conveyor and the in feed conveyor 10 are accurately indexed relative to one another as described previously and as disclosed in the above mentioned patent applications. The above mentioned clutch assures that the proper timing is maintained by a switch strategically provided in the case conveyor system.

I claim:

1. In a machine of the type wherein upwardly open packing cases are moved in spaced relationship to one another and in a downstream direction toward a station where they are to be loaded, each case having leading and trailing top flaps hingedly connected to the front and rear end panels respectively, and wherein these top flaps are to be opened prior to arrival of the case at such a load station, the improvement comprising (a) leading front top flap opening mechanism provided above the path of movement of the cases and including rotating flap engageable wheels clustered so that their axes are spaced from one another less than one half their combined diameters, and so that their respective peripheries have segments overlapping one another at least slightly, (b) adjacent wheels of said clustered wheels displaced axially relative to one another at least in the region where their segments overlap, said wheels having substantially the same rotational speeds, which wheels speed results in tangential peripheral speeds for the wheels exceeding that of the speed of movement of the cases moving in the downstream directions below said adjacent wheels, (c) one of said adjacent clustered wheels defining a radially outwardly open notch with a first side trailing a second notch side as viewed in the direction of wheel rotation, said first notch side defined more particularly by a radially outwardly and tangentially forwardly projecting portion of said one wheel periphery, said one wheel projecting portion adapted to move downwardly into the packing case and then upwardly at a peripheral speed greater than that of the packing case to raise the leading top flap as said one wheel portion continues to rotate through an angle at least approximately equal to the corresponding angular displacement of the top flap itself as measured from an initial closed position relative the case, (d) another of said adjacent wheels also defining a radially outwardly open notch with first trailing and second leading notch sides, said first notch side so defined in said another adjacent wheel and said wheels so timed relative to one another that said another wheel notch has its trailing notch side engageable with said leading top flap as said projection portion moves upwardly out of contact with the leading top flap to fold the latter through an additional angle which is approximately equal to the corresponding additional angular displacement of the top flap as measured from its initial closed position and after said angular displacement acheived by said one wheel projecting portion, (e) a third clustered wheel adjacent said another of said clustered wheels and having its axis spaced from said another wheel less than one half their respective combined diameters so that their respective peripheries have segments that overlap one another at least slightly, said third wheel arranged downstream of said one and said another wheel cluster and also defining a radially outwardly open notch with a first side trailing a second notch side as viewed in the direction of wheel rotation, all of said wheels rotating in the same direction.

2. The combination defined in claim 1 above wherein one of said wheels is defined by two axially spaced discs of substantially identical peripheral configuration.

3. The combination defined by claim 1 above wherein the axis of said another wheel is located slightly above a generally horizontal line connecting the axis of said one and third wheels, wherein the diameters of all three such wheels is substantially similar save for a peripheral segment of said another wheel opposite the notch defining portion thereof, said opposite side of said another wheel having a segment of its periphery spaced radially outwardly of the major portion of its periphery by a dimension approximately equal to the spacing of the axis of rotation of said another wheel above said generally horizontal line.

4. The combination defined in claim 3 wherein said third wheel has a second notch side trailing said first notch side, and wherein said first notch side includes a rearwardly projecting flexible finger portion projecting radially outwardly with respect to the axis of rotation of said third wheel and extending toward the second notched side so as to engage the leading top flap and resiliently urge the leading top flap downwardly and ahead of the path of movement of the case into a position wherein it projects generally perpendicularly to the front panel of the case and forwardly in the direction of case movement, and fixed guide means for holding the leading top flap in such position as the case proceeds downstream toward a case loading station.

5. The combination defined in claim 4 wherein said another wheel is defined by two axially spaced discs of substantially identical peripheral configuration.

6. The combination defined in claim 5 wherein said third wheel is provided in the same vertical plane as that of said one wheel and wherein said first and third wheels have peripheral segments rotating between said spaced wheels discs of said second wheel.

* * * * *